US011198915B2

(12) United States Patent
Sohmshetty et al.

(10) Patent No.: US 11,198,915 B2
(45) Date of Patent: Dec. 14, 2021

(54) HYBRID QUENCH PROCESS FOR HOT STAMPING OF STEEL PARTS

(71) Applicant: Ford Motor Company, Dearborn, MI (US)

(72) Inventors: Raj Sohmshetty, Canton, MI (US); Constantin Chiriac, Windsor (CA); Mikhail Minevich, Southfield, MI (US); Jason Balzer, Commerce Township, MI (US); S. George Luckey, Jr., Dearborn, MI (US)

(73) Assignee: Ford Motor Company, Dearborn, MI (US)

( * ) Notice: Subject to any disclaimer, the term of this patent is extended or adjusted under 35 U.S.C. 154(b) by 603 days.

(21) Appl. No.: 15/892,122

(22) Filed: Feb. 8, 2018

(65) Prior Publication Data

US 2019/0241987 A1 Aug. 8, 2019

(51) Int. Cl.

| | |
|---|---|
| ***C21D 6/00*** | (2006.01) |
| ***C22C 38/00*** | (2006.01) |
| ***C21D 1/18*** | (2006.01) |
| ***C21D 1/58*** | (2006.01) |
| ***C21D 1/60*** | (2006.01) |
| ***C21D 1/667*** | (2006.01) |

(Continued)

(52) U.S. Cl.

CPC ..... *C21D 6/008* (2013.01); *C21D 1/18* (2013.01); *C21D 1/58* (2013.01); *C21D 1/60* (2013.01); *C21D 1/667* (2013.01); *C21D 1/673* (2013.01); *C21D 6/005* (2013.01); *C22C 38/002* (2013.01); *C22C 38/02* (2013.01); *C22C 38/04* (2013.01)

(58) Field of Classification Search

None

See application file for complete search history.

(56) References Cited

U.S. PATENT DOCUMENTS

| | | | |
|---|---|---|---|
| 9,206,488 | B2 | 12/2015 | Ishiguro et al. |
| 9,469,891 | B2 | 10/2016 | Okita et al. |

(Continued)

FOREIGN PATENT DOCUMENTS

| | | | |
|---|---|---|---|
| DE | 102011053941 A1 * | 3/2013 | ..... C21D 1/673 |
| WO | 2010/061007 | 6/2010 | |

OTHER PUBLICATIONS

WIPO machine translation of WO 2010/061007 (Year: 2020).*

(Continued)

*Primary Examiner* — Patricia L. Hailey
*Assistant Examiner* — Christopher D. Moody
(74) *Attorney, Agent, or Firm* — Burris Law, PLLC

(57) ABSTRACT

A method of quenching a press hardenable steel is provided. The method includes an initial step of die quenching a part stamped within a stamping die followed by a partial quenching after the initial step of die quenching. In various methods, the press hardenable steel is a 36MnB5 grade steel and/or the initial step of die quenching is performed at a temperature of approximately 200° C.±10° C. in a die configured for 36MnB5 grade steel. At least one method further includes opening the die followed by the partial quenching, the partial quenching comprising spraying a cooling liquid onto the part to reduce a temperature of the part below approximately 130° C.±10° C., with the option of spraying to reduce the temperature of the part below approximately 100° C.±10° C.

14 Claims, 6 Drawing Sheets

(51) Int. Cl.

| | |
|---|---|
| ***C21D 1/673*** | (2006.01) |
| ***C22C 38/02*** | (2006.01) |
| ***C22C 38/04*** | (2006.01) |

(56) References Cited

U.S. PATENT DOCUMENTS

| | | | | |
|---|---|---|---|---|
| 2006/0185774 | A1* | 8/2006 | Nishibata | C22C 38/28<br>148/653 |
| 2011/0315281 | A1 | 12/2011 | Charest et al. | |
| 2014/0352388 | A1 | 12/2014 | Balint et al. | |
| 2016/0168676 | A1* | 6/2016 | Luckey, Jr. | C22C 21/08<br>148/695 |

OTHER PUBLICATIONS

Espacenet machine translation of DE 10 2011 053941 (Year: 2020).*

Totten et al., "Quenching of Steel," ASM International, ASM Handbook, vol. 4A, Steel Heat Treating Fundamentals and Processes, p. 91-157 DOI: 10.31399/asm.hb.v04a.a0005824 (Year: 2013).*

"Quench hardening of steel", Total Materia, 2000, http://www.totalmateria.com/articles/Art12.htm (Year: 2000).*

Graves, B., Novel Press Hardening Process for Boron Steel, available at URL https://www.imperialinnovations.co.uk/media/uploads/files/5877_Press_hardening_process_for_boron_steel.pdf.

* cited by examiner

HYBRID QUENCH PROCESS FOR HOT STAMPING OF STEEL PARTS

FIELD

The present disclosure relates to high strength press hardenable steel (PHS) and methods of manufacturing parts from PHS.

BACKGROUND

The statements in this section merely provide background information related to the present disclosure and may not constitute prior art.

There is an increasing demand to reduce the weight of vehicle structures while meeting various strength and safety requirements, leading vehicle teams to investigate high strength steels. One category of high strength steel is Boron based steel, with 22MnB5 grade steel with an Al—Si coating (Usibor® 1500 trade name from Arcelor Mittal) as an industry leading Boron-based steel. Typical material properties for 22MnB5 grade steel after heat treatment are ~1200 MPa yield strength and ~1500 MPa ultimate tensile strength.

22MnB5 grade steel is a press hardenable steel (PHS). The press hardening process is a hot stamping process that allows high strength steels to be formed into complex shapes, which is not feasible (or cost-prohibitive) with regular cold stamping operations. Press hardening has two main processes: direct press hardening and indirect press hardening.

During direct press hardening, an unformed blank is heated in a furnace, formed in hot condition, and quenched in a die to achieve the required mechanical properties. During indirect press hardening, an unformed blank is formed, trimmed, and pierced in a cold condition, the formed blank is then heated and quenched in a die to get high strength properties. The choice of direct or indirect press hardening depends on part complexity and blank coating (Zinc-based coatings typically employ indirect processes). In either method, the blank is formed in a much softer and formable state and is later hardened in the dies. High strength steels have a formability that is lower than milder grades. In addition, high strength steels have higher spring-back and die wear issues as the forming stresses and contact pressures are higher.

A new grade of PHS is 36MnB5 grade steel (Usibor® 2000 from Arcelor Mittal), which is a Boron-based steel and has the potential to further reduce the weight of hot stamped parts. 36MnB5 grade steel has the potential to achieve material properties after heat treatment of greater than 1400 MPa yield strength and greater than 2000 MPa ultimate tensile strength. 36MnB5 grade steel requires a significantly lower part extraction temperature than 22MnB5 grade steel to achieve the target mechanical properties resulting in a 1.5-5 second increase in die quenching time over 22MnB5 grade steel. An increase in die quench time between 22MnB5 grade steel and 36MnB5 grade steel of 5 seconds, results in at least a 10% increase in processing costs. To date, an increase in quench time of greater than or equal to 1 second has been considered cost-prohibitive for low, medium, or high-volume production replacement of 22MnB5 grade steel with 36MnB5 grade steel.

Furthermore, 36MnB5 grade steel is more sensitive to variations in cooling profiles than 22MnB5 grade steel, resulting in higher quality control costs. Processing of 36MnB5 grade steel may involve additional costs from improved cooling systems, die thermal conductivity, contact pressures and process controls. For at least these reasons 36MnB5 grade steel has not yet been fully integrated into vehicle structures.

The present disclosure addresses these issues and other issues related to press hardenable steels.

SUMMARY

In one form of the present disclosure, a method for quenching a press hardenable steel (PHS) is provided. The method comprises an initial step of die quenching a part stamped within a stamping die followed by a partial quenching after the initial step of die quenching.

In another method of the present disclosure, the PHS has a composition comprising, in weight percent (wt. %): manganese greater than zero and up to 1.4 wt. %; silicon greater than zero and up to 0.7 wt. %; carbon greater than zero and up to 0.37 wt. %; and boron greater than zero and up to 0.005 wt. %.

In at least one method of the present disclosure, the initial step of die quenching is performed in a die configured for a PHS comprising: manganese greater than zero and up to 1.4 wt. %; silicon greater than zero and up to 0.4 wt. %; carbon greater than zero and up to 0.25 wt. %; and boron greater than zero and up to 0.005 wt. %. In various methods of the present disclosure, the initial step of die quenching is performed at a temperature of approximately 200° C.±10° C.

Yet another method of the present disclosure further comprises opening the die followed by the partial quenching and the partial quenching comprises spraying a cooling liquid onto the part to reduce a temperature of the part below approximately 130° C.±10° C. In a method of the present disclosure, the spraying reduces the temperature of the part below approximately 100° C.±10° C. In methods of the present disclosure, the cooling liquid is selected from the group consisting of chlorofluorocarbons (CFCs), diesters, esters, glycol, polyglycol, synthetic fluids, semi-synthetic fluids, water, a combination of water and salt, a combination of water and oil, and combinations thereof.

A part is also manufactured according to the various methods of the present disclosure.

Another method of the present disclosure further comprises opening the die and transferring the part to a chiller, wherein the partial quenching comprises cooling the part in the chiller to reduce a temperature of the part below approximately 130° C.±10° C., and then transferring the part to a rack or other containment or inventory device.

In yet another method of the present disclosure, the cooling in the chiller reduces the temperature of the part to below approximately 100° C.±10° C.

In one chiller of the present disclosure, the chiller includes a flow and filtration system. In another chiller of the present disclosure, the part is vertically oriented within the chiller during the partial quenching. In at least one chiller of the present disclosure, the chiller includes a cooling liquid selected from the group consisting of chlorofluorocarbons (CFCs), diesters, esters, glycol, polyglycol, synthetic fluids, semi-synthetic fluids, water, a combination of water and salt, a combination of water and oil, and combinations thereof. In yet another chiller, the cooling liquid is agitated. In at least one chiller of the present disclosure, a thicker portion of the part enters the chiller before other thinner portions of the part.

In another form of the present disclosure, a method for quenching a press hardenable steel (PHS) is provided. The method comprises an initial step of die quenching a part within a die followed by a partial quenching after the initial step of die quenching, wherein there is no pre-quench step prior to the initial step of die quenching.

In a method of the present disclosure, the partial quenching is one of spraying a cooling liquid onto the part and cooling the part in a chiller to reduce a temperature of the part below approximately 130° C.±10° C.

In yet another form of the present disclosure, a method of quenching a press hardenable steel (PHS) that is brought to a temperature of approximately 200° C.±10° C. after being stamped into a part in a stamping die is provided. The method comprises an initial step of die quenching the part followed by partial quenching after the initial step of die quenching.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
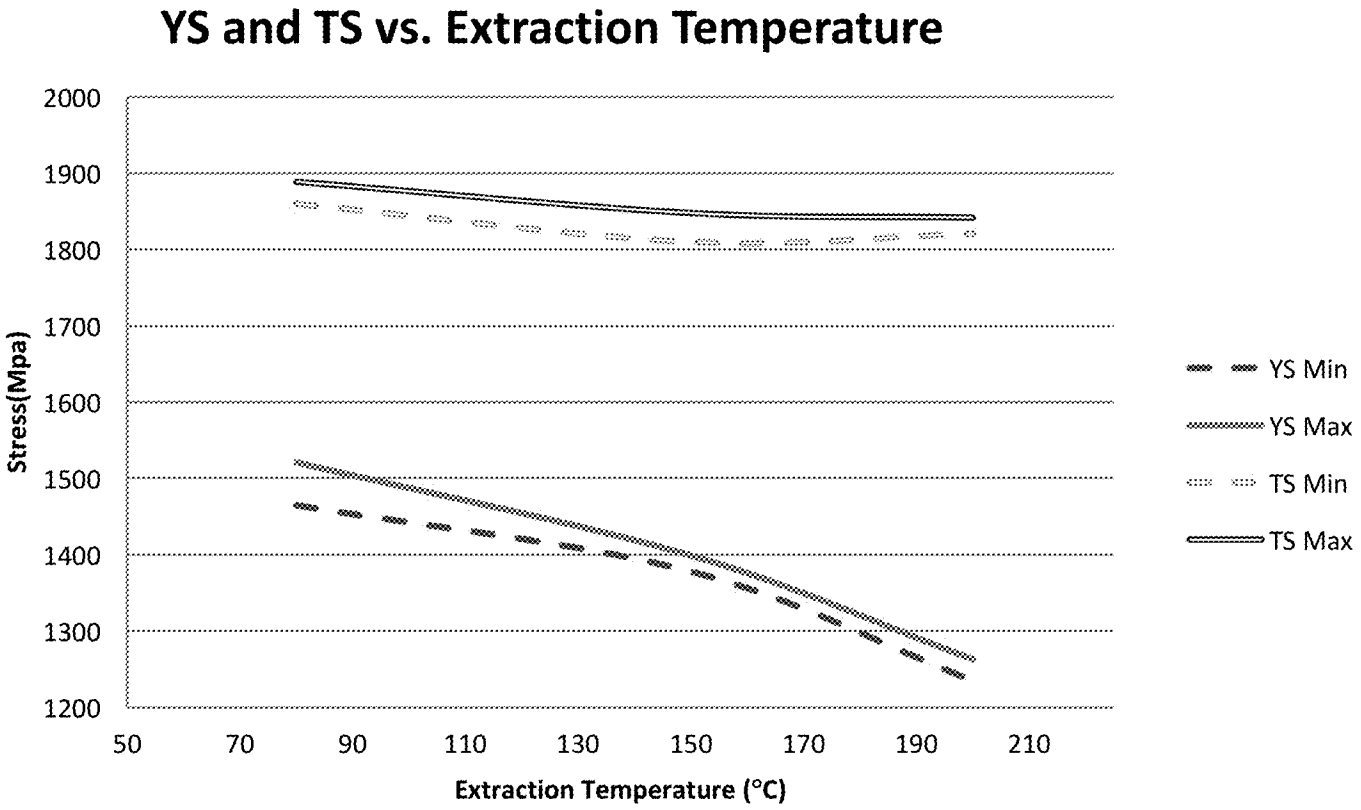
FIG. 1 illustrates the relationship between strength and part extraction temperature for 36MnB5 grade steel.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Generally, to address issues related to forming a press hardenable steel (PHS) while using manufacturing equipment designed for 22MnB5 grade PHS, the present disclosure partially quenches a 36MnB5 PHS to less than or equal to about 200° C.±10° C. during a stamping operation.

This improvement in press hardening of 36MnB5 steels was unexpected because there was no indication that an extra (supplemental) quenching processing step would be beneficial and cost effective. This is because industry commercialization efforts are using new manufacturing equipment tailored for 36MnB5 steels, as 36MnB5 steels are more sensitive to variations in cooling profiles than 22MnB5 grade steel.

The inventors discovered that between production conditions for 22MnB5 grade steel and 36MnB5 grade steel, die quench time for 36MnB5 grade steel would be significantly higher than 22MnB5 grade steel. The inventors also discovered that the yield strength (YS) and the ultimate tensile strength (UTS) of 36MnB5 grade steel would be lower than the specification using existing production equipment/processing. This is reflected below in Table 1:

TABLE 1

22MnB5 and 36MnB5 grade steel simulated press hardening on a 22MnB5 grade steel production path with about a 210° C. part extraction temperature

| Specimen | YS (MPa) | UTS (MPa) | % EL |
|---|---|---|---|
| 22MnB5 PHS #112 | 1013 | 1456 | 18 |
| 22MnB5 PHS #114 | 1050 | 1468 | 17 |
| Ave | 1031.5 | 1462 | 17.5 |
| 36MnB5 PHS #109 | 1247 | 1824 | 12 |
| 36MnB5 PHS #110 | 1235 | 1821 | 15 |
| Ave | 1241 | 1822.5 | 13.5 |
| Specification | ≥1400 | ≥1800 | ≥4 |

As shown, 22MnB5 grade steel properties for YS and UTS are within the specification for typical production part extraction temperature of about 200° C. However, the yield strength for 36MnB5 grade steel processed with 22MnB5 grade steel typical production part extraction temperatures were below the 36MnB5 yield strength specification of greater than or equal to 1400 MPa.

Referring to FIG. 1, the relationship between strength and part extraction temperature for 36MnB5 grade steel processed with 22MnB5 grade steel hot-stamping tooling and procedures is shown as discovered by the inventors. As illustrated, the tensile strength (TS) of the 36MnB5 grade steel is relatively constant (≤75 MPa) with respect to the part extraction temperature over the range of about 75-200° C. However, the yield strength of the 36MnB5 grade steel is varies by about 300 MPa and is therefore dependent upon the part extraction temperature over the range of about 75-200° C. The desired yield strength for 36MnB5 grade steel is greater than 1400 MPa, which shows that 36MnB5 grade steel is enabled for production when the part extraction temperature is below about 130° C.

Figure 2:
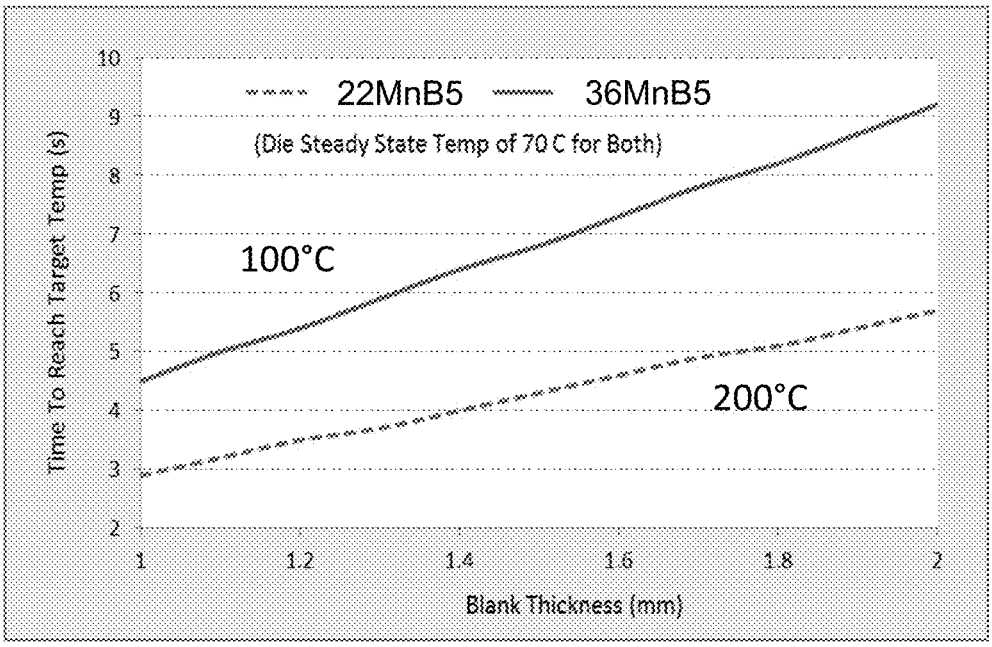
Prior Art FIG. 2
FIG. 2 illustrates the relationship between the cooling rate and the blank thickness for 22MnB5 and 36MnB5 grade steels.
Figure 3:
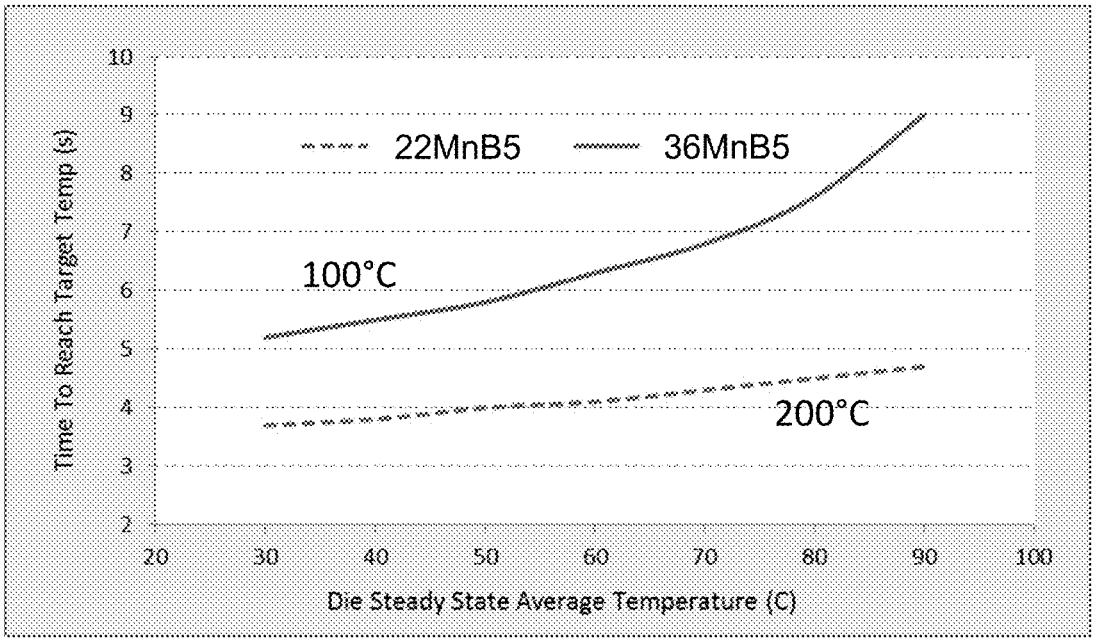
Prior Art FIG. 3
FIG. 3 illustrates the relationship between the cooling rate and the die temperature for 22MnB5 and 36MnB5 grade steels.
Figure 4:
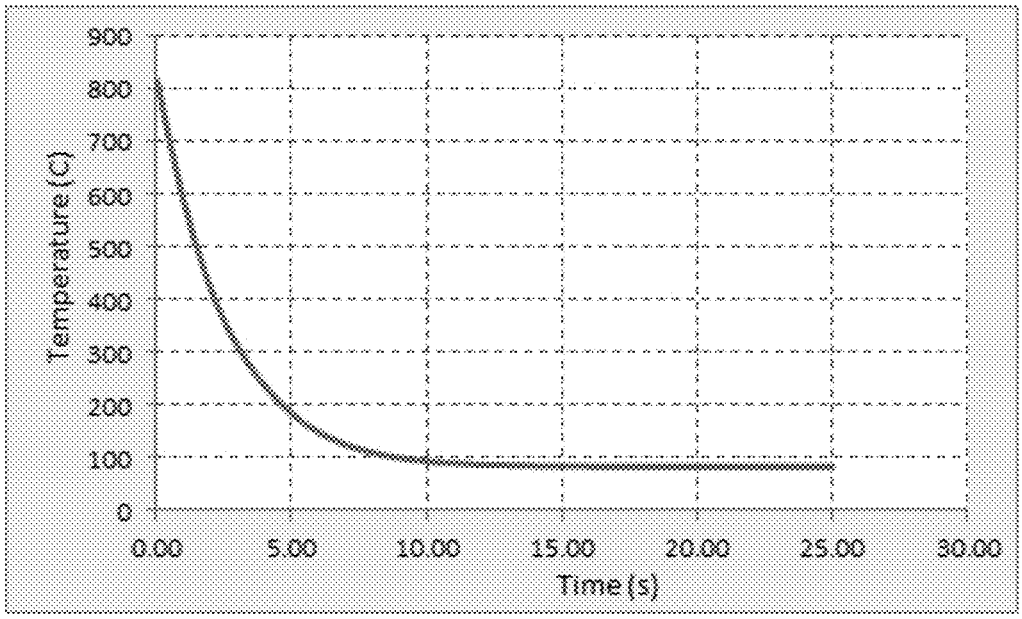
FIG. 4 Prior Art
FIG. 4 illustrates the relationship between blank temperature and time for a 1.5 mm 36MnB5 grade steel blank to cool from about 830° C. to about 200° C.
Figure 5:
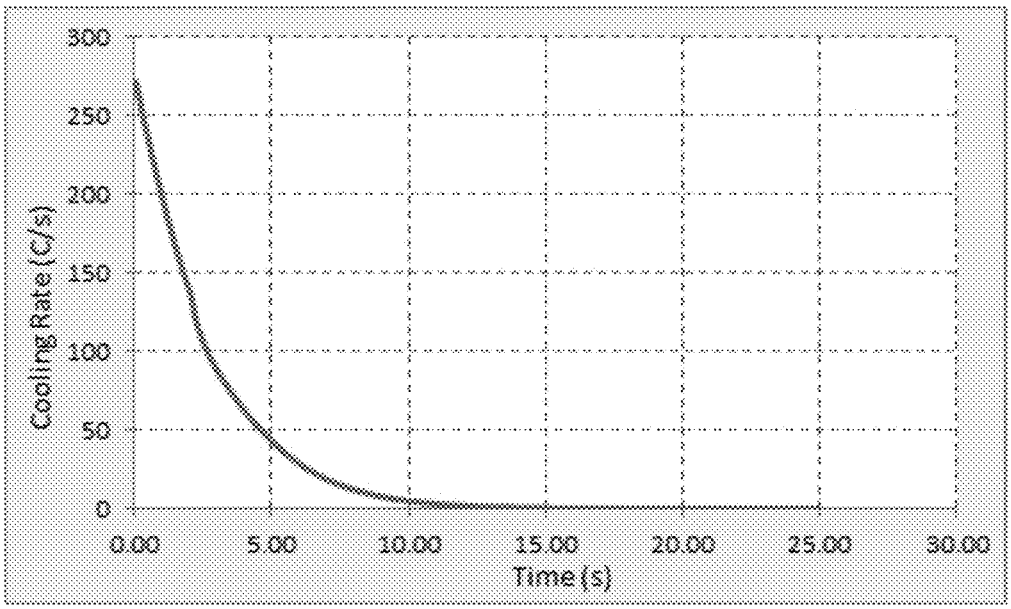
FIG. 5 Prior Art
FIG. 5 illustrates the relationship between cooling rate and time for a 1.5 mm 36MnB5 grade steel blank to cool from about 830° C. to about 200° C.
Figure 6:
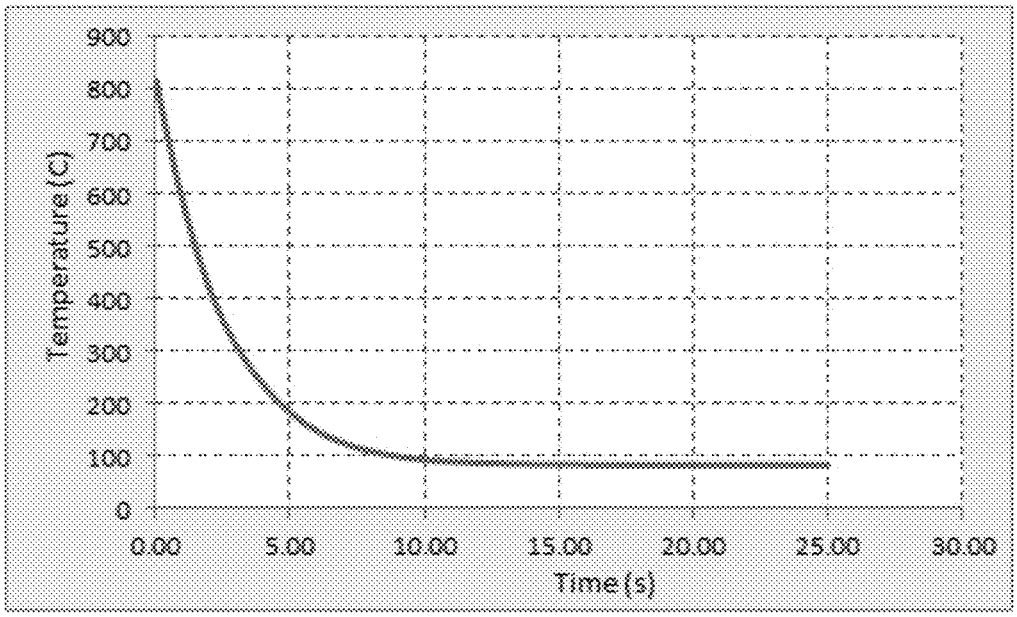
Prior Art FIG. 6
FIG. 6 illustrates the relationship between blank temperature and time for a 1.5 mm 36MnB5 grade steel blank to cool from about 830° C. to about 100° C.
Figure 7:
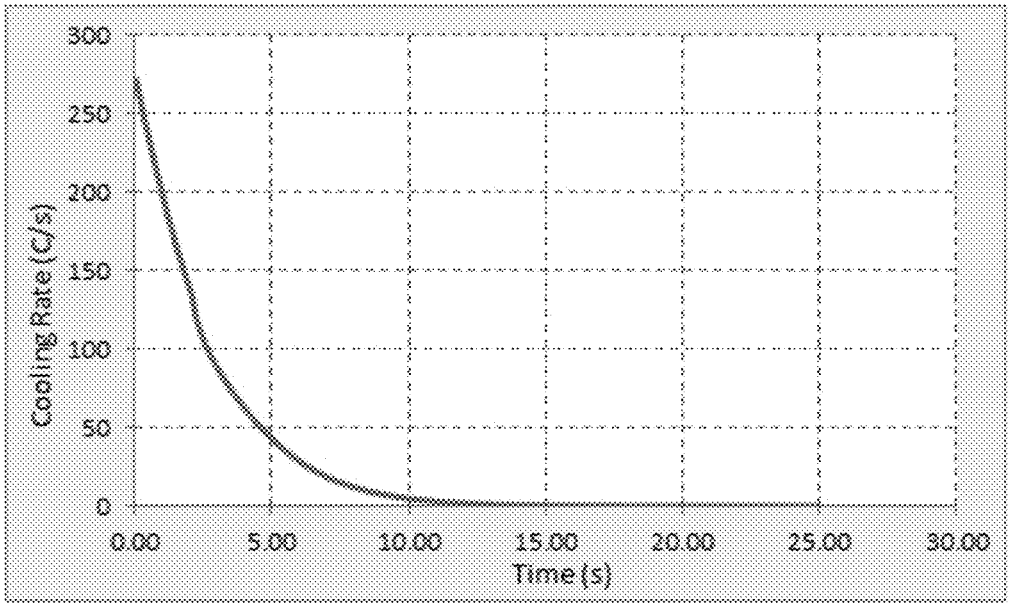
Prior Art FIG. 7
FIG. 7 illustrates the relationship between cooling rate and time for a 1.5 mm 36MnB5 grade steel blank to cool from about 830° C. to about 100° C.

Referring to FIGS. 2-3, the differences to reach the target temperatures for 22MnB5 grade steel and 36MnB5 grade steel are plotted with respect to blank thickness (FIG. 2) and die steady state temperature (FIG. 3) as discovered by the inventors. The inventors discovered that the difference in time to reach the target extraction temperatures for 36MnB5 grade steel versus 22MnB5 grade steel varies by 1.5-5 seconds. These results showed that the mechanical properties of 36MnB5 grade steel are more sensitive to variations in the cooling systems (quenching technology and processes) than 22MnB5 grade steel.

According to the present disclosure, one method to reduce 36MnB5 grade steel quench time is to reduce the Time-Temperature-Transformation (TTT) relationship and therefore the time to quench the 36MnB5 grade steel. Numerous analyses and testing resulted in the processing parameters of TABLE 2 below and the relationships shown FIG. 4 through FIG. 7.

TABLE 2

36MnB5 grade steel Time-Temperature-Transformation quenching parameters

| | 22MnB5 grade steel | 36MnB5 grade steel | 36MnB5 grade steel |
|---|---|---|---|
| Plate thickness (mm) | 1.5 | 1.5 | 1.5 |
| Die contact pressure (MPa) | 19.1 | 19.1 | 19.1 |
| Die contact heat transfer coefficient (W/K*m^2) | 2302 | 2302 | 2302 |
| Die thermal conductivity (W/K*m) | 28 | 28 | 28 |
| Die surface absorptivity | 0.6 | 0.6 | 0.6 |
| Die steady state average temperature (° C.) | 83 | 83 | 83 |
| Part quench temperature (° C.) | 200 ± 10 | 200 ± 10 | 100 ± 10 |
| Time to quench (seconds) | ~4.7 | ~4.7 | ~9** |
| Distance to cooling channel (mm) | 10 | 10 | 10 |
| Ave. YS (MPa) | ~1030 | ~1240* | ≥1400 |
| Ave. UTS (MPa) | ~1460 | ~1822* | ≥1800 |

*Below material specification

**Cost-prohibitive for low, medium, or high-volume production

The die contact pressure is the pressure between the die and the steel and the distance to cooling channel is the distance between the center of the cooling channel to the die contact surface. Further, as die thermal conductivity increases, the abrasive resistance of the die reduces, therefore an abrasive resistant coating and/or surface hardening of the dies may be desired.

In one form, the present disclosure provides a method in which the mold or die is opened after the hot blank has been formed. More specifically, the mold or die is opened when the formed blank or part is at a temperature between the martensite start temperature and the martensite finish temperature of the formed blank. A cooling liquid or cooling media is sprayed into the open die onto the formed blank to reduce the temperature to less than or equal to 100° C. The cooling liquid may be applied as a mist, slurry, powder, or combinations thereof. The cooling liquid may include chlorofluorocarbons (CFCs), diesters, esters, glycol, polyglycol, synthetic fluids, semi-synthetic fluids, water, a combination of water and salt, a combination of water and oil, combinations thereof, and any other type of coolant mixture to control and modify the cooling rate of the formed blank or die surface. In one form, a fan enables convective cooling of the formed blank, the die, and moves the cooling liquid.

In another form of the present disclosure, the formed blank is transferred to a chiller or chilling system. The chiller or chilling system cools the part to a temperature to less than or equal to 100° C. ("target temperature"). The cooled formed blank is then transferred to a rack. The chiller or chilling system includes a flow system to maintain the target temperature and a filtration system to reduce contaminants in the coolant.

The inventors have discovered that different cooling liquids, cooling fluids, and cooling media have different effects on the characteristics of the cooled or quenched part. Some cooling media distort, crack, or otherwise decrease the properties (e.g. mechanical or aesthetic) of the cooled part. Mixing cooling liquids together often mitigates the decreases in properties of the cooled part. As an example, water may cool the part too quickly leading to cracks or distortion. By adding chlorofluorocarbons (CFCs), diesters, esters, glycol, polyglycol, synthetic fluids, semi-synthetic fluids, salt (up to 20%), oil, and combinations thereof (for example synthetic fluids are often diluted 3-10%), or another material to the water that improves the cooling rate, cracks or distortion due to the quench may be inhibited. Other methods to mitigate decreases in quenched properties include:

heating the cooling liquid;
cooling the heating liquid;
cooling long parts vertically;
cooling flat parts on edge;
cooling thick sections first or preferentially; and
agitating the cooling liquid to reduce vaporization (e.g. steam) of the cooling liquid.

The present provides methods of manufacture that produce 36MnB5 or equivalent grade PHS in about the same cycle time as 22MnB5 grade PHS with 22MnB5 grade steel processing and manufacturing equipment.

Figure 8:
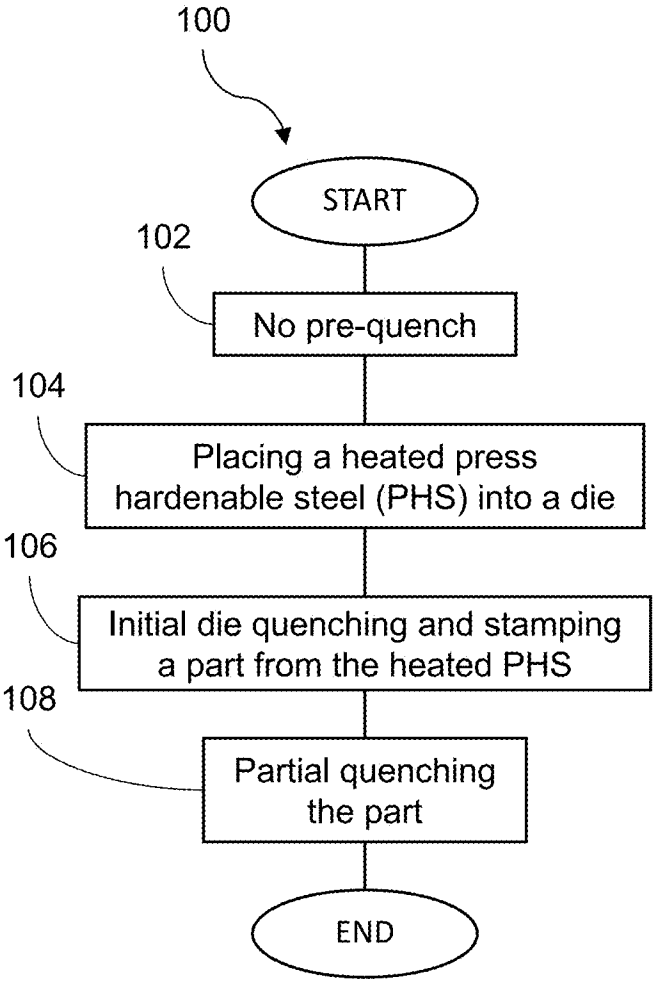
FIG. 8 is a flowchart for a method of quenching a press hardenable steel without a pre-quench, according to the teachings of the present disclosure.

More specifically, and referring to FIG. 8, one method for quenching a press hardenable steel (PHS) 100 is provided. The method 100 comprises an initial step of die quenching a part within a die followed by a partial quenching after the initial step of die quenching, wherein there is no pre-quench step prior to the initial step of die quenching. In short, first quench the part or blank encounters in the process is the initial step of die quenching the part within the die. In other words, the method brings the PHS to an elevated temperature and does not pre-quench the PHS 102 before placing the PHS into a die 104. Then an initial die quenching, the first quench in the method, and stamping of the heated PHS into a part is performed 106. Following the initial quenching and stamping, the PHS part is partially quenched 108.

In a variation of this method, the partial quenching is one of spraying a cooling liquid onto the part and cooling the part in a chiller to reduce a temperature of the part below approximately 130° C.±10° C. ("target temperature").

Figure 9:
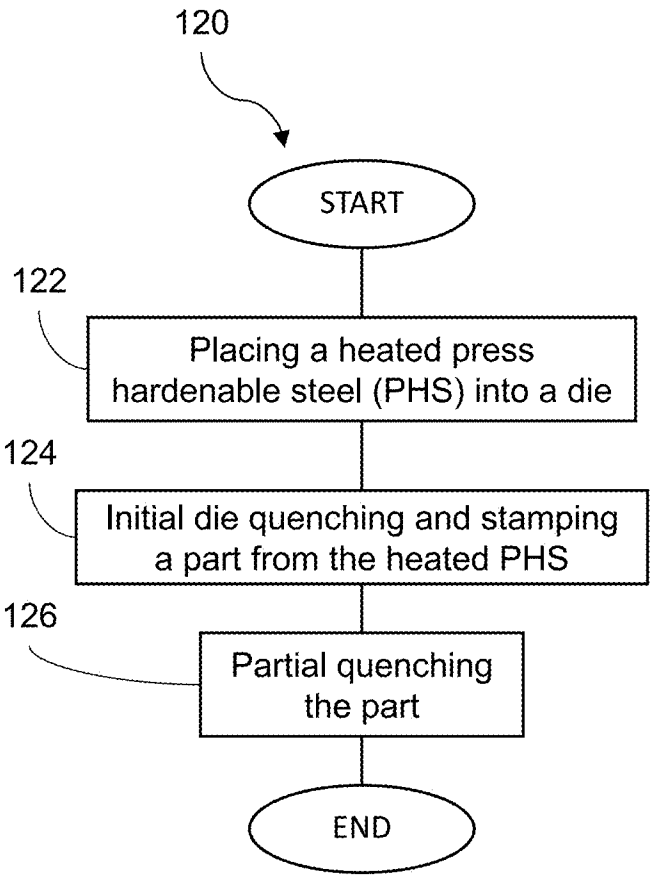
FIG. 9 is a flowchart for a method of quenching a press hardenable steel, according to the teachings of the present disclosure.

Referring now to FIG. 9, another method for quenching a press hardenable steel (PHS) 120 is provided according to the teachings of the present disclosure. The method 120 brings the PHS to an elevated temperature, places the PHS into a die 122, and comprises an initial step of die quenching a PHS part stamped within the stamping die 124, followed by a partial quenching 126 after the initial step of die quenching.

In another method of the present disclosure, the PHS has a composition comprising, in weight percent (wt. %): manganese greater than zero and up to 1.4 wt. %; silicon greater than zero and up to 0.7 wt. %; carbon greater than zero and up to 0.37 wt. %; and boron greater than zero and up to 0.005 wt. % as shown below in TABLE 3.

TABLE 3

| Element | Minimum wt. % | Maximum wt. % |
|---|---|---|
| Boron | >0 | 0.005 |
| Carbon | >0 | 0.37 |
| Manganese | >0 | 1.4 |
| Silicon | >0 | 0.7 |
| Iron | Balance | Balance |

In at least one method of the present disclosure, the initial step of die quenching is performed in a die configured for a PHS comprising: manganese greater than zero and up to 1.4 wt. %; silicon greater than zero and up to 0.4 wt. %; carbon greater than zero and up to 0.25 wt. %; and boron greater than zero and up to 0.005 wt. % as shown below in TABLE 4.

TABLE 4

| Element | Minimum wt. % | Maximum wt. % |
|---|---|---|
| Boron | >0 | 0.005 |
| Carbon | >0 | 0.25 |
| Manganese | >0 | 1.4 |
| Silicon | >0 | 0.4 |
| Iron | Balance | Balance |

In various methods of the present disclosure, the initial step of die quenching is performed at a temperature of approximately 200° C.±10° C.

Yet another method of the present disclosure comprises opening the die followed by the partial quenching, and the partial quenching comprises spraying a cooling liquid onto the part to reduce a temperature of the part below approximately 130° C.±10° C. In a variation of this method, the spraying reduces the temperature of the part below approximately 100° C.±10° C. The cooling liquid is selected from the group consisting of chlorofluorocarbons (CFCs), diesters, esters, glycol, polyglycol, synthetic fluids, semi-synthetic fluids, water, a combination of water and salt, a combination of water and oil, and combinations thereof.

Still another method according to the present disclosure comprises opening the die and transferring the part to a chiller, wherein the partial quenching comprises cooling the part in the chiller to reduce a temperature of the part below approximately 130° C.±10° C.; and then transferring the part to a rack or other containment or inventory device. In a variation of this method, the cooling in the chiller reduces the temperature of the part to below approximately 100° C.±10° C.

In form, the chiller includes a flow and filtration system. In another form, the part is vertically oriented within the chiller during the partial quenching. In yet another form, the chiller includes a cooling liquid selected from the group consisting of chlorofluorocarbons (CFCs), diesters, esters, glycol, polyglycol, synthetic fluids, semi-synthetic fluids, water, a combination of water and salt, a combination of water and oil, and combinations thereof. In yet form, the cooling liquid is agitated. In still another form, a thicker portion of the part enters the chiller before other thinner portions of the part. A flow and filtration system may also be provided.

Figure 10:
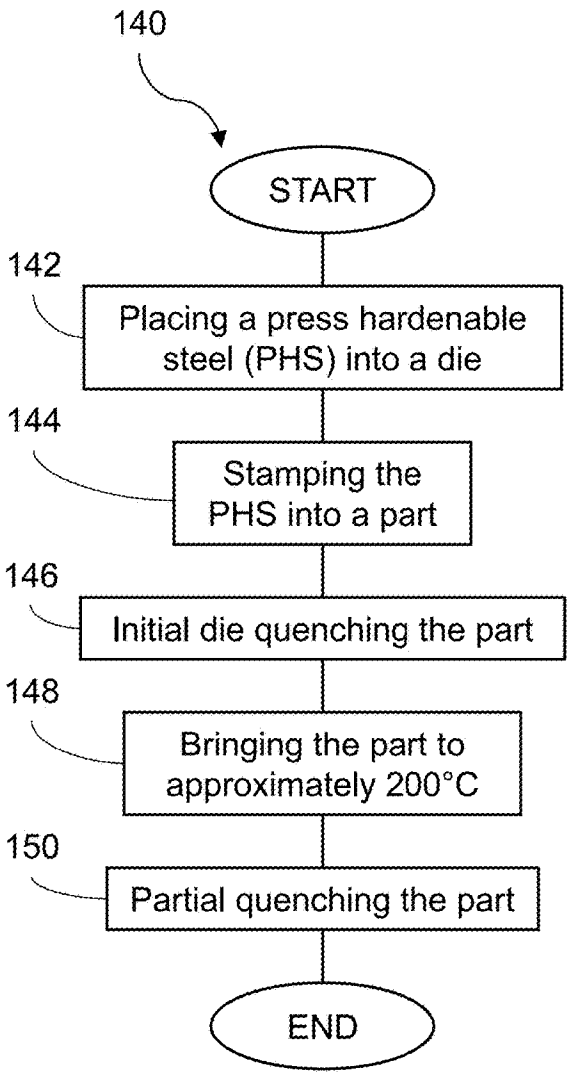
FIG. 10 is a flowchart for a method of quenching a press hardenable steel brought to a temperature of approximately 200° C., according to the teachings of the present disclosure.

Referring to FIG. 10, another method according to the present disclosure is illustrated by reference numeral 140. This method 140 includes quenching a press hardenable steel (PHS) that is brought to a temperature of approximately 200° C.±10° C. after being stamped into a part in a stamping die. The method comprises an initial step of die quenching the part followed by partial quenching after the initial step of die quenching. Generally, a PHS is placed into a die 142 and the PHS is stamped into a part 144. Then, an initial die quenching of the part 146 brings the part to approximately 200° C. 148, followed by a partial quenching of the part 150.

Additionally, various parts may be formed according the teachings of the present disclosure.

Throughout the application, with respect to process or measurable variables (temperature, composition, time, etc.), "approximate," "about," "~," and similar expressions indicate that the value is within manufacturing tolerances and variabilities as determined by regular practice in the industry and machine capability.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A method of quenching a press hardenable steel (PHS) comprising an initial step of die quenching a part stamped within a stamping die followed by a partial quenching after the initial step of die quenching, wherein there is no pre-quench step prior to the initial step of die quenching, the initial step of die quenching quenches the part within the stamping die to a temperature of approximately 200° C.±10° C. and the partial quenching reduces a temperature of the stamped part from approximately 200° C.±10° C. to below approximately 130° C.±10° C.

2. The method according to claim 1, wherein the PHS has a composition comprising:

manganese greater than zero and up to 1.4 wt. %;
silicon greater than zero and up to 0.7 wt. %;
carbon greater than zero and up to 0.37 wt. %; and
boron greater than zero and up to 0.005 wt. %.

3. The method according to claim 1, wherein the stamping die is configured for a PHS comprising:

manganese greater than zero and up to 1.4 wt. %;
silicon greater than zero and up to 0.4 wt. %;
carbon greater than zero and up to 0.25 wt. %; and
boron greater than zero and up to 0.005 wt. %.

4. The method according to claim 1 further comprising opening the stamping die followed by the partial quenching, the partial quenching, wherein the partial quenching comprises spraying a cooling liquid onto the part.

5. The method according to claim 4, wherein the spraying reduces the temperature of the part below approximately 100° C.±10° C.

6. The method according to claim 4, wherein the cooling liquid is selected from the group consisting of water, chlorofluorocarbons (CFCs), diesters, esters, glycol, polyglycol, synthetic fluids, semi-synthetic fluids, water and salt, water and oil, and combinations thereof.

7. A part manufactured according to the method of claim 1.

8. The method according to claim 1 further comprising:

opening the stamping die and transferring the part to a chiller, wherein the partial quenching comprises cooling the part in the chiller to reduce a temperature of the part below approximately 130° C.±10° C.; and transferring the part to a rack.

9. The method according to claim 8, wherein the cooling in the chiller reduces the temperature of the part below approximately 100° C.±10° C.

10. The method according to claim 8, wherein the chiller includes a flow and filtration system.

11. The method according to claim 8, wherein the part is vertically oriented within the chiller during the partial quenching.

12. The method according to claim 8, wherein the chiller includes a cooling liquid selected from the group consisting of chlorofluorocarbons (CFCs), diesters, esters, glycol, polyglycol, synthetic fluids, semi-synthetic fluids, water, a combination of water and salt, a combination of water and oil, and combinations thereof.

13. The method according to claim 12, wherein the cooling liquid is agitated.

14. The method according to claim 8, wherein the part has a thick portion and a thin portion with a thickness less than the thick portion, and the thick portion of the part enters the chiller before the thin portion of the part.

* * * * *